United States Patent [19]

Prichard

[11] 3,973,505

[45] Aug. 10, 1976

[54] TUFTING MACHINES

[75] Inventor: Richard J. Prichard, Chattanooga, Tenn.

[73] Assignee: The Singer Company, New York, N.Y.

[22] Filed: Oct. 31, 1975

[21] Appl. No.: 627,720

[52] U.S. Cl. ..... 112/79 R; 74/590

[51] Int. Cl.[2] ..... D05C 15/08

[58] Field of Search ..... 112/79 R, 79 A, 78, 112/218 R; 173/139, 162; 74/61, 590, 604

[56] References Cited

UNITED STATES PATENTS

| | | | |
|---|---|---|---|
| 3,112,657 | 12/1963 | Huck | 74/590 |
| 3,421,929 | 1/1969 | Watkins | 112/79 R |
| 3,422,688 | 1/1969 | Bruderer | 74/590 X |
| 3,435,689 | 4/1969 | Parish | 74/590 X |

*Primary Examiner*—H. Hampton Hunter

*Attorney, Agent, or Firm*—E. L. Bell; R. E. Smith; A. Ruderman

[57] ABSTRACT

A tufting machine bed having an oscillating looper assembly in which the oscillating mass is counter-balanced by mechanism including a weight which oscillates about a pivot point in the bed in a direction opposite to that of the looper assembly. The oscillatory motion of the counter-balancing assembly is derived from the same oscillating shaft that drives the looper assembly.

5 Claims, 2 Drawing Figures

TUFTING MACHINES

BACKGROUND OF THE INVENTION

This invention relates to tufting machines and more particularly to a means for balancing the oscillatory forces of the tufting machine looper assembly.

Tufting machines incorporate a multiplicity of yarn carrying needles which reciprocate cyclically to penetrate a backing fabric and cooperate with a multiplicity of loopers beneath the backing to form pile in the backing. The loopers of conventional tufting machines are driven with an oscillatory motion into loop seizing engagement with the needles. The forces generated by the oscillating looper assembly create equal and opposite reaction forces in the frame of the tufting machine. These reaction forces result in a vibration of the frame. With the recent increase in operational speed of tufting machines, the magnitude of these forces and the resultant vibrations have now reached unacceptable levels. The machines shake excessively in their foundations with the end result being machine degradation and waste of energy. The horizontal vibration levels in the bed of the machine have now been found to be the most unacceptable and substantially all of the horizontal vibration is now attributed to the looper mechanism.

SUMMARY OF THE INVENTION

Consequently, the present invention provides a simple solution to the vibration problem by providing a looper assembly counter-balancing construction that has been found to reduce the horizontal vibrations by approximately 80 per cent. The oscillating mass of the looper assembly is effectively balanced by a weight which oscillates about a pivot point in the bed of the frame in a direction opposite to that of the loopers and which is connected to the looper drive by linkages similar to that used to drive the loopers.

Accordingly, it is a primary object of the present invention to provide a counter-balancing system for tufting machines having an oscillating looper assembly so as to minimize the horizontal vibrations in the bed of the machine.

BRIEF DESCRIPTION OF THE DRAWINGS

Other objects and advantages of this invention will best be understood upon reading the following detailed description of the invention with the accompanying drawings, in which.

DETAILED DESCRIPTION OF THE PREFERRED EMBODIMENT

Figure 2:
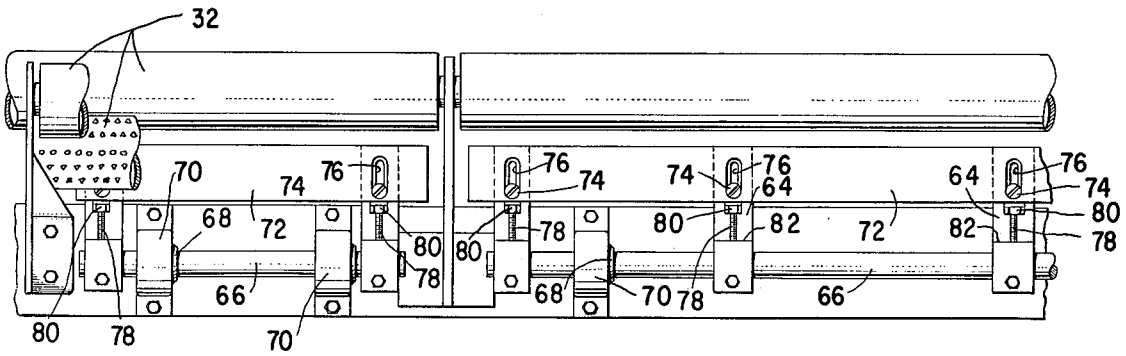
FIG. 2 is an elevational view of the bed of the tufting machine viewed from the right side of FIG. 1 illustrating portions of the counter-balancing structure.
Figure 1:
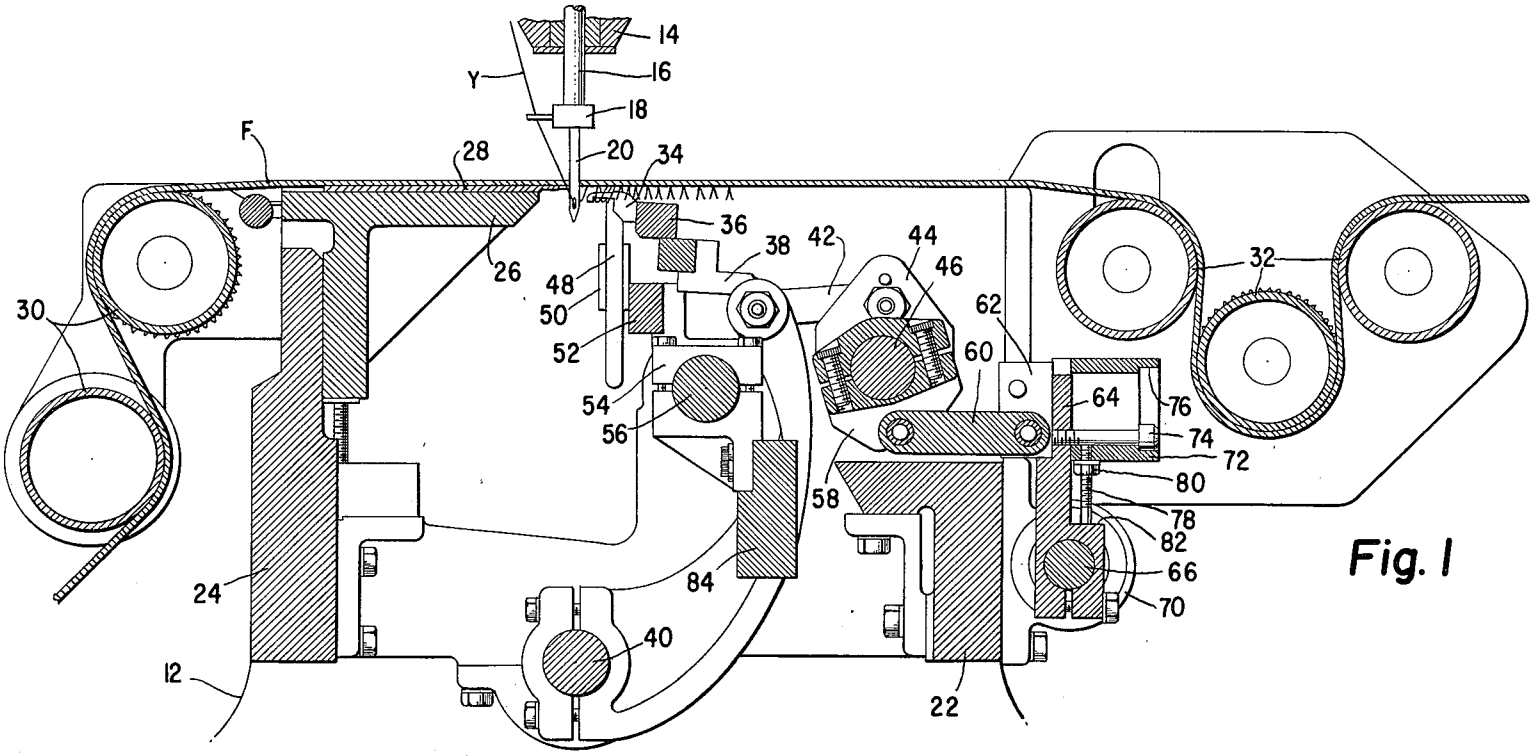
FIG. 1 is a fragmentary sectional view of a tufting machine incorporating the looper counter-balancing construction of the present invention.

Referring now to the drawings there is illustrated a portion of a tufting machine having a frame comprising a base 12 and a head 14 disposed above the base. Mounted in the head 14 for vertical reciprocation is one of a plurality of push rods 16 to the lower end of which a needle bar 18 is carried and which in turn carries a plurality of needles 20 (only one of which is illustrated). Endwise reciprocation is imparted to the push rods 16 and thereby to the needles by conventional means not illustrated.

The base 12 includes a bed 22 including a front bed plate 24 having an adjustable bed plate 26. Supported on the adjustable bed plate is a needle plate 28 over which a backing fabric F is fed from front feed rollers 30 to rear feed rollers 32.

Mounted within the bed for cooperation with the needles to seize yarn Y presented thereby are a plurality of loopers or hooks 34 which are mounted in looper bars 36 secured to the upper end of a rocker arm 38. The lower end of the rocker arm 38 is clamped to a laterally extending rock shaft 40 journalled in the bed. Pivotably connected to the upper portion of the rocker arm 38 is one end of a connecting link 42 having its other end pivotably connected between bifurcated arms of a jack shaft rocker arm 44. The rocker arm 44 is clamped to a jack shaft 46 which has oscillatory motion imparted thereto by conventional drive means (not shown) in timed relationship with the reciprocation of the needles. As illustrated the tufting machine may incorporate a plurality of knives 48 which cooperate with the loopers so as to cut loops seized by the looper to form cut pile fabrics. The knives may be mounted in knife blocks 50 secured to a knife bar 52 which is in turn secured to a knife shaft rocker arm 54 clamped to a knife shaft 56. Oscillating movement is imparted to the knife shaft 56 to conventionally drive the knife into engagement with the loopers as known in the art.

The mechanism thus far described is conventional. The motion of the oscillating shaft 46 is imparted to the rocker arm 44 which drives the connecting link 42 to oscillate the looper rocker arm 38 about the pivot shaft 40 so that the looper 34 oscillates about the shaft 40. Since the radius of oscillation of the looper 34 is so great relative to the small arc through which the looper 34 moves, the movement of the looper may be treated as reciprocation. The counter-balancing assembly of the present invention takes this into account so as to minimize the size of the components.

The assembly provides a rocker arm 58 which is clamped to the jack shaft 46. The rocker arm 58 is similar to the rocker arm 44 and has one end of a connecting link 60 journalled between its bifurcated arms. The other end of the connecting link 60 is journalled or pivotably connected to a bar 62 which is secured to another rocker arm 64. The rocker arm 64 is clamped to a shaft 66 supported in bearings 68 mounted in pillow blocks 70. The upper end of the rocker arm 64 supports a weight 72 which may be in the form of a channel member and is secured to the rocker arm 64 by means of shoulder screws 74 positioned within elongated slots 76. The weight may be adjusted vertically and to this end there is provided an adjustment screw 78 threaded into the bottom of the weight and having a lock nut 80 for bearing against the bottom of the weight to lock the weight in the adjusted position. The other end of the screw 78 bears within a shoulder portion 82 of the rocker arm 64. Thus, the weight 72 may be adjusted by loosening the shoulder screws 74, and the nut 80 and adjusting the screws 78 to re-position the weight. The adjustment is provided so that the effective mass moment of the counter-balancing system may be finely controlled. If desired the knife assembly also may be counter-balanced by a weight 84 secured to the bottom portion of the knife rocker arm 54.

Although only one looper and counter-balancing assembly is illustrated it may be noted that a full size tufting machine may have approximately 1000 loopers on a number of rocker arms arranged laterally across the machine. The precise number of loopers is of course dependent on the width of the product produced and the gauge, i.e., the spacing between the loopers, or needles. The counter-balancing assembly must balance the total weight of the loopers and the developed movements. Thus, the elements of the counter-balance assembly oscillate in the plane of oscillation of the loopers but in a direction opposite thereto. The counter-balancing assemblies should be spaced laterally across the machine, but the number of such assemblies do not appear critical. Approximately one such assembly per foot has been found to perform well. In one such machine the horizontal vibrations were reduced approximately 80 per cent.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. In a tufting machine having a bed, a rocker arm pivotably mounted in the bed, a plurality of laterally spaced loopers each adapted to seize a loop of yarn presented thereto, means for securing said loopers to the rocker arm, a laterally extending oscillating shaft mounted in the bed, a rocker member secured to said shaft, and means pivotably connected to said rocker arm and said rocker member for oscillating said rocker arm and thereby said loopers in a plane substantially normal to said shaft, the improvement comprising: a second rocker member secured to said shaft for movement in said plane in a direction opposite to that of said loopers, a second rocker arm pivotably mounted in said bed for movement in said plane, a counter-balancing weight secured to said second rocker arm, and connecting means pivotably connected to said second rocker member and to said second rocker arm for oscillating said weight in a direction opposite to that of the loopers.

2. In a tufting machine as recited in claim 1 wherein said weight is adjustably positionable along said second rocker arm.

3. In a tufting machine as recited in claim 1 wherein said shaft is disposed intermediate said rocker arms.

4. In a tufting machine having a bed, a plurality of laterally spaced loopers each adapted to cooperate with a corresponding needle to seize a loop of yarn presented thereto, and means including a laterally extending oscillating shaft mounted in the bed for oscillating said loopers in a plane substantially normal to said shaft, the improvement comprising: a first rocker arm secured to said shaft for movement in said plane in a direction opposite to that of said loopers, a second rocker arm pivotably mounted in said bed for movement in said plane, a counter-balancing weight secured to said second rocker arm, and connecting means pivotably connected to said first rocker arm and to said second rocker arm for oscillating said weight in a direction opposite to that of the loopers.

5. In a tufting machine as recited in claim 4 wherein said weight is adjustably positionable along said second rocker arm.

* * * * *